US005199902A

United States Patent [19]

Kahle et al.

[11] Patent Number: 5,199,902

[45] Date of Patent: Apr. 6, 1993

[54] CONNECTOR DEVICE

[75] Inventors: Lane D. Kahle, Bradford; Phillip C. Poux, Russell, both of Pa.

[73] Assignee: GTE Products Corporation, Danvers, Mass.

[21] Appl. No.: 812,304

[22] Filed: Dec. 23, 1991

[51] Int. Cl.[5] ..... H01R 13/40

[52] U.S. Cl. ..... 439/595; 439/352; 439/752

[58] Field of Search ..... 439/345, 350, 352, 357, 439/353, 354, 355, 594, 595, 603, 752, 842, 852

[56] References Cited

U.S. PATENT DOCUMENTS 4,565,416 1/1986 Rudy et al. ..... 439/595 X
4,867,711 9/1989 Yuasa ..... 439/752
4,886,474 12/1989 Drogo ..... 439/842 X
4,946,395 8/1990 Cope et al. ..... 439/352
4,973,268 11/1990 Smith et al. ..... 439/595
4,997,386 3/1991 Kawachi et al. ..... 439/355 X
5,044,991 9/1991 Colleran et al. ..... 439/595
5,074,803 12/1991 Chandler et al. ..... 439/352 X
5,085,599 2/1992 Maejima et al. ..... 439/595

*Primary Examiner*—Larry I. Schwartz
*Assistant Examiner*—Khiem Nguyen
*Attorney, Agent, or Firm*—William H. McNeill

[57] ABSTRACT

A connector device including a first connector having a latch which mates with a bracket of a second connector, the two connector halves being locked together by a sliding key which can be moved from a locked position to an unlocked position. A female contact is provided which includes a tri-beam end for electrical connection with a mating male contact and a recessed intermediate area which mates with a slidable locking member to lock the female contact in place vis-a-vis a receptacle housing.

14 Claims, 5 Drawing Sheets

CONNECTOR DEVICE

BACKGROUND OF THE INVENTION

1. Field of the Invention

The present invention relates to a connector device which includes a locking feature for locking a receptacle contact in place, a positive locking system for guaranteeing that two connector halves are fully mated and will not inadvertently disconnect, and hooded tri-beam contacts.

2. Description of the Prior Art

The need for assuring the integrity of an electrical system which is subjected to strenuous conditions is well known. For example, it is well known that to ensure safe and predictable performance of an automobile under all conditions of use requires that the electrical connection between a receptacle which forms part of a wire harness assembly and the corresponding PC board mounted header not be inadvertently interrupted. In one respect, the integrity of such an electrical system depends upon the electrical contacts being satisfactorily locked into position relative to a respective connector half. In another respect, it is very important that the connector halves be fully mated and locked in place relative to each other. Finally, there must be satisfactory socket contact, that is, the contact between the male and female contacts of each connector half must be satisfactory. Regarding this last aspect, prior art female contacts have been in the form of two beam hooded configurations which have not provided the degree of electrical connections which might be achieved.

It is an object of the present invention to provide a positive locking system for locking together a first connector and a second connector.

Another object of the present invention is to provide a positive locking system for fully mating and locking together a header connector and a receptacle connector.

Yet another object of the present invention is to provide a positive locking system for use with electrical connectors, such system including a minimum of parts.

Another object of the present invention is to provide a positive locking system for locking a contact into place vis-a-vis a receptacle housing.

A further object of the present invention is to provide improved socket contact between male and female contacts.

Yet another object of the present invention is to protect a multi-beam female contact from handling damage.

Another object of the present invention is to provide anti-overstress protection of a multi-beam female contact.

SUMMARY OF THE INVENTION

This invention achieves these and other results by providing a connector device which includes a first connector having a plurality of first contacts and a mating second connector having a plurality of second contacts, the first contacts being electrically connected to the second contacts when the first connector is coupled to the second connector. The connector device comprises first means integral with the first connector for removably coupling the first connector to the second connector. Such first means includes a latch which is integral with the first connector. Second means is provided integral with the second connector for mating with the first means. The second means includes a bracket integral with the second connector and alignable with and receivable of the latch when the first connector is coupled to the second connector. The first means further includes a third means disposed between the latch and the first connector and slidable relative to the latch to a first position and a second position for unlocking the latch relative to the bracket when in the first position, and locking the latch relative to the bracket when in the second position, when the first connector is coupled to the second connector.

A connector device is also provided which includes a plurality of female contacts each of which comprises means disposed at a first end of each female contact for attaching an electrical conductor to the female contact, and an opposite second end. Each opposite second end comprises three identical resilient beams which are equally spaced about a longitudinal axis of the female contact and include opposing female contact surfaces. The female contact surfaces are configured to engage a male contact of a plurality of corresponding male contacts, when a first connector is coupled to a second connector, at corresponding male contact surfaces which are equally spaced about a longitudinal axis of the male contact. A plurality of open ended cylindrical hoods is also provided each of which is concentric relative to an opposite second end of a female contact and includes an inner surface which engages an outer surface of the opposite second end of the female contact.

A connector device is also provided which includes a first connector having a plurality of first contacts for mating with a second connector having a plurality of corresponding second contacts, the first contacts being electrically connected to the second contacts when the first connector is coupled to the second connector, and including a receptacle housing containing the first contacts. Each first contact has an intermediate length having a reduced width, measured transverse to a longitudinal axis of the first contact, relative to the width, measured transverse to a longitudinal axis of the first contact, of adjacent lengths of the first contact. First means are insertable through apertures in the receptacle housing and slidable to a first position, and a second position, relative to each intermediate length, for unlocking each first contact relative to the receptacle housing in the first position and locking each first contact relative to the receptacle housing in the second position.

BRIEF DESCRIPTION OF THE DRAWINGS

This invention may be clearly understood by reference to the attached drawings in which.

DESCRIPTION OF THE PREFERRED EMBODIMENT

Figure 1:
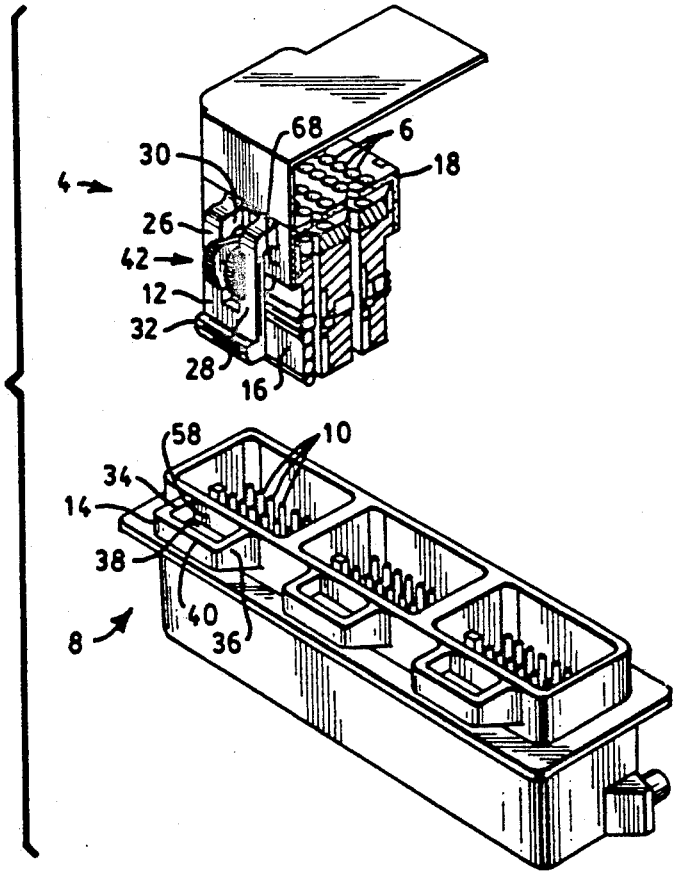
FIG. 1 is a view of a complete connector system of the present invention showing one connector half in its entirety and a cross section of one of three identical receptacle connector halves that mate with it.

The embodiment of this invention which is illustrated in FIG. 1 is particularly suited for achieving the object of this invention. FIG. 1 depicts a connector device 2 which includes a first connector 4 having a plurality of first contacts 6 and a mating second connector 8 having a plurality of second contacts 10. Without limitation, the second connector 8 is depicted as a PC board mounted header which is for use in an automobile, and the first connector 4 is depicted as a cross section of one of three identical receptacle connectors that mate with it and which are part of a wire harness assembly. In use, the first contacts 6 will be electrically connected to the second contacts 10 when the first connector 4 is coupled to the second connector 8 in a known manner. For example, in the embodiment of FIG. 1, the first contacts 6 are female contacts which are electrically connected to the second contacts 10, which are male contacts, when the male contacts are inserted into the female contacts.

Figure 2:
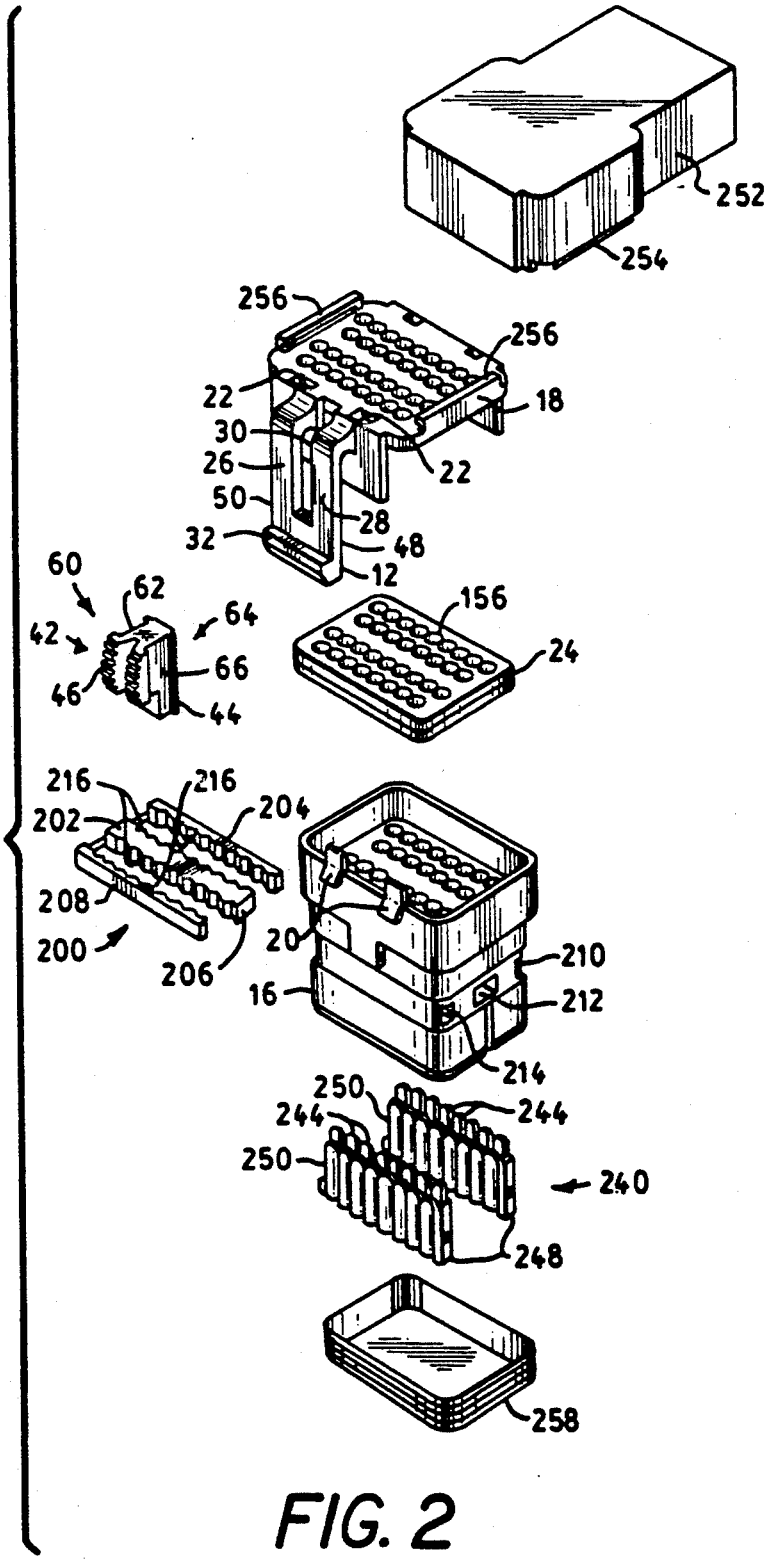
FIG. 2 is an exploded view of a receptacle connector of the present invention.

In the preferred embodiment a first means is provided which is integral with the first connector 4 for removably coupling the first connector to the second connector 8. A corresponding second means is provided which is integral with the second connector 8 for mating with such first means. For example, in the embodiment of FIG. 1 the first means includes a latch 12 and the second means includes a bracket 14 which is alignable with and receivable of the latch when the first connector is coupled to the second connector. Referring to FIGS. 1 and 2, in the preferred embodiment the first connector 4 comprises a receptacle housing 16 which contains the first contacts 6 and an insulator cover means 18 which is attached to the receptacle housing for insulating the first contacts as, for example, by means of protuberances 20 which provide a snap fit with openings 22. Preferably, a grommet 24 is interposed between receptacle housing 16 and insulator cover means 18. The latch 12 comprises a first leg 26 integral with and extending from the insulator cover means 18 which forms part of the first connector 4 and a second leg 28 integral with and extending from such insulator cover means. The second leg 28 is separated from the first leg 26 to form a first opening 30 between the legs. The distal ends of the legs 26 and 28 are bridged by a flange 32.

In the preferred embodiment, the bracket 14 includes a first arm 34 and a second arm 36 each of which is integral with and extends from the second connector 8 as depicted in FIG. 1. Arms 34 and 36 are separated from each other to form a second opening 38. Distal ends of arms 34 and 36 are bridged by a bridge member 40. As depicted in FIG. 1, flange 32 is configured in the form of a snap-like coupling for mating with bridge member 40 when the latch 12 is inserted into the opening 38 of bracket 14 when the first connector 4 is coupled to the second connector 8.

Figure 3A:
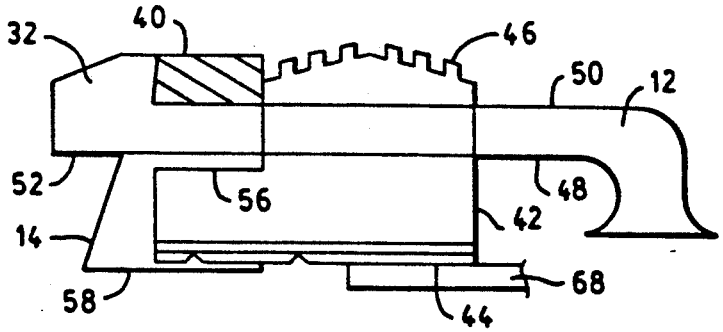
FIG. 3A is a schematic view of the connector locking system of the present invention in a locked position.
Figure 3B:
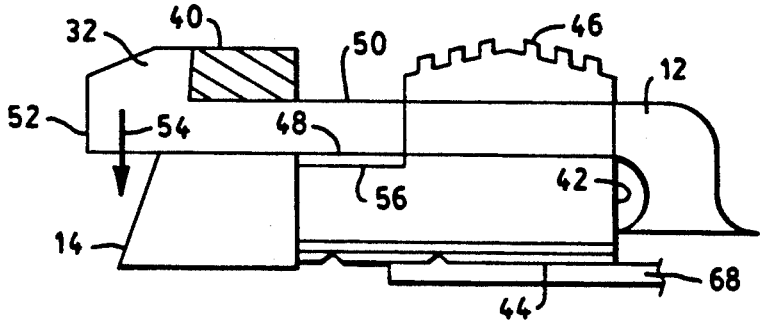
FIG. 3B is a schematic view of the connector locking system of FIG. 3A in an unlocked position.

The first means of FIGS. 1 and 2 also includes a third means disposed between latch 12 and the first connector 4 and slidable relative to the latch to a first position and a second position for unlocking the latch 12 relative to the bracket 14 when in such first position, and for locking the latch relative to the bracket when in such second position, when the first connector 4 is coupled to the second connector 8. In the preferred embodiment, such third means comprises a key 42. Referring to FIGS. 1 to 3, key 42 includes a first surface 44 and an opposite second surface 46. The key 42 extends through the first opening 30 such that the first surface 44 extends from the first opening at a side 48 of the latch 12 adjacent the first connector and the second surface 46 extends from the first opening at an opposite side 50 of the latch. Key 42 is thereby slidable along the opening 30 relative to the legs 26 and 28 to a first position (FIG. 3B) wherein the latch 12 is unlocked relative to the bracket 14 and to a second position (FIG. 3A) wherein the latch 12 is locked relative to the bracket 14. For example, when the key 42 is moved to the unlocked position of FIG. 3B, the end 52 of the resilient latch 12 is free to pivot in the direction of arrow 54 using the position 56 of the key 42 as a pivot point such that the snap-like flange 32 will pivot below bridge member 40 of bracket 14 to unlock the first connector 4 relative to the second connector 8. On the other hand, when the key 42 is moved to the locked position of FIG. 3A, the portion 56 of the key 42 will be interposed between the snap-like flange 32 and a surface 58 of the second connector 8 to prevent pivoting of the snap-like flange 32, in the direction of arrow 54, to an unlocked position.

In the preferred embodiment the key 42 will be snapped through opening 30. To facilitate sliding of the key 42, the key may be fabricated to include a first channel 60 at a first side having a base 62 which engages the leg 26 and a second channel 64 at an opposite second side having a base 66 which engages the leg 28. In addition, the insulator cover means 18 may include a skirt 68 which is spaced from the legs 26 and 28 such that the first surface 44 of the key 42 will be disposed between the latch 12 and the skirt as depicted in FIGS. 1 and 3. In essence, the key bridges the latch to the skirt which acts as an anti-overstress for the latch should a wire wrap around the latch during wire harness build.

Figure 4:
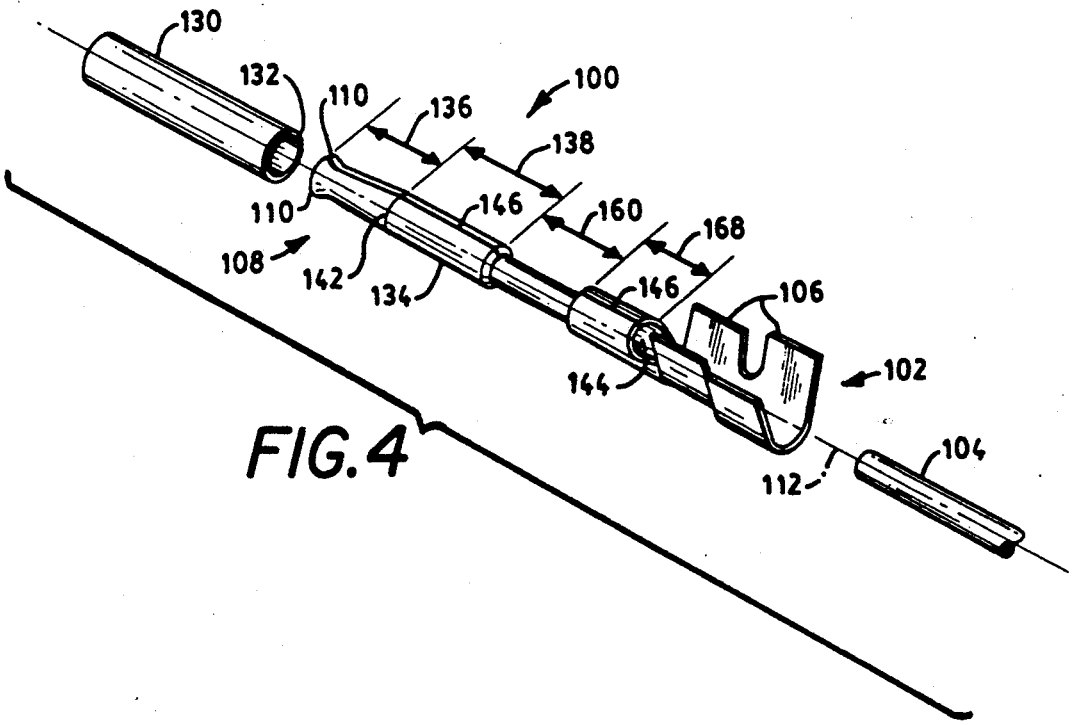
FIG. 4 is an exploded view of a female contact and hood of the present invention.
Figure 5:
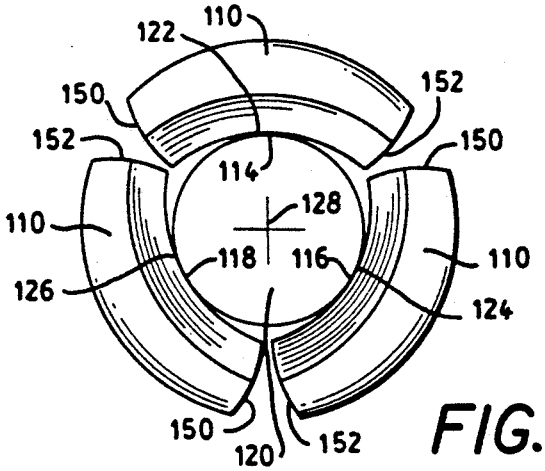
FIG. 5 is a schematic view of the female contact of FIG. 4 mated with a male contact without a hood.
Figure 6:
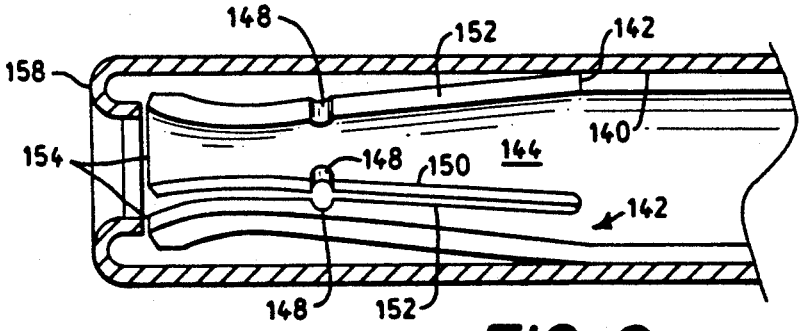
FIG. 6 is a sectional view of the hooded end of the female contact of FIG. 4.

In the preferred embodiment a connector device is provided wherein each female contact includes a first end including means for attachment of an electrical conductor and an opposite second end which is a three beam structure. For example, in the embodiment of FIGS. 1 to 3, the first contacts 6 are female contacts and the second contacts 10 are male contacts. Female contacts 6 can be in the form of female contacts 100 as depicted in FIGS. 4 to 6. Female contacts 100 comprise means disposed at a first end 102 for attaching an electrical conductor 104 to the female contact. For example, such means may include tabs 106 which can be crimped about conductor 104 in a known manner. The opposite second end 108 comprises three identical resilient beams 110 which are equally spaced about a longitudinal axis 112 of the female contact 100 and include opposing female contact surfaces 114, 116, 118 which are configured to engage a male contact 120 at corresponding male contact surfaces 122, 124, 126 which are also equally spaced about a longitudinal axis 128 of the male contact as depicted diagrammatically in FIG. 5.

Each female contact 100 also comprises an open ended cylindrical hood 130 which is concentric relative to end 108 of the female contact and includes and inner surface 132 which engages an outer surface 134 of end 108 of the female contact. In the preferred embodiment, end 108 includes a distal length 136 which comprises the beams 110 and an adjacent cylindrical length 138 having an outer diameter dimentioned to provide a force fit with inner surface 132 of the hood 130 as depicted at 140 in FIG. 6. In the preferred embodiment, each beam 110 has an end 142 which is integral with and merges into the cylindrical length 138 as depicted in FIGS. 4 and 6. Female contacts 100 are preferably fabricated by known stamping techniques whereby each female contact will comprise a single piece of metal in tubular form having a longitudinal aperture 144 therethrough and a seam 146. In order to prevent over stress of each contact 100 each beam 110 includes a notch or groove 148 cut out of opposing edges 150, 152 of the beams, the grooves 148 being spaced from a distal end 154 of the beams. Preferably, each groove is spaced an equal distance from the distal end 154 as depicted in FIG. 6. In order to facilitate insertion of the contacts through the contact openings 156 in the grommet 24 when the first connector 4 is coupled to the second connector 8, the leading edge of each hood 130 is configured in the form of a rollover 158 as depicted in FIG. 6.

In the preferred embodiment, each female contact 100 comprises an intermediate length 160 having a reduced width or diameter measured transverse to axis 112, relative to the width or diameter, also measured transverse to axis 112, of adjacent lengths 138 and 168 of the female contact. Preferably, intermediate length 160 is a cylindrical length disposed between cylindrical lengths 138 and 168. Without limitation, in the preferred embodiment the female contacts 100 are fabricated from C19500HD, the contact surfaces 114, 116, 118 are gold plate (0.000762 inches thick) or solder plate (0.0050 inches thick) over nickel (0.0012 inches thick), the hoods 130 are fabricated from C26000 (unplatted), and the female contacts are pressure filled with grease.

Figure 8A:
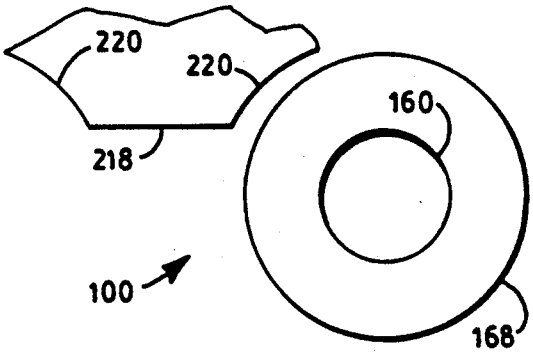
FIG. 8A is a diagrammatic view of the contact locking mechanism of FIG. 7A in an unlocked position.
Figure 8B:
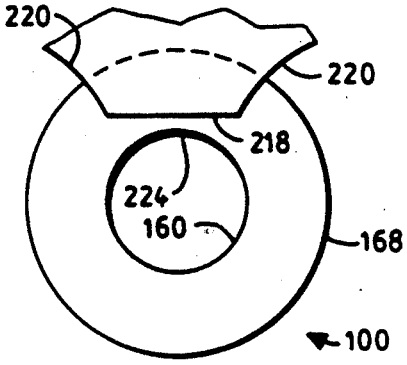
FIG. 8B is a diagrammatic view of the contact locking mechanism of FIG. 7B in a locked position.
Figure 7A:
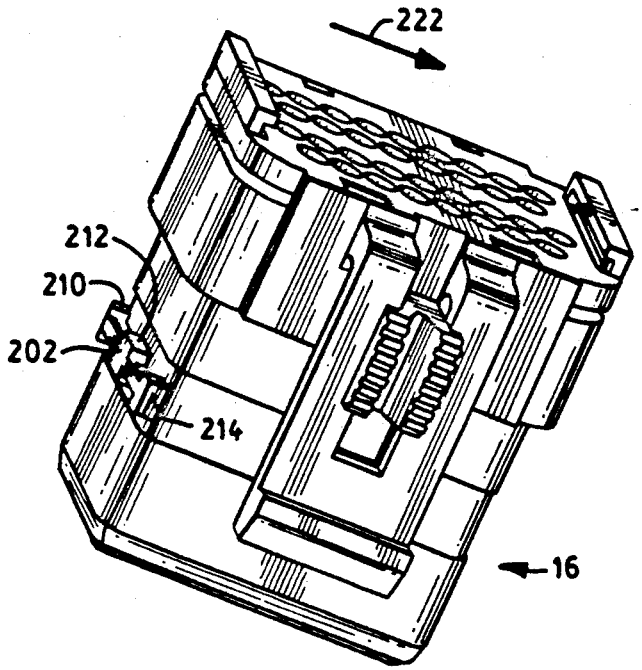
FIG. 7A is a view of the contact locking device of the present invention in an unlocked position.
Figure 7B:
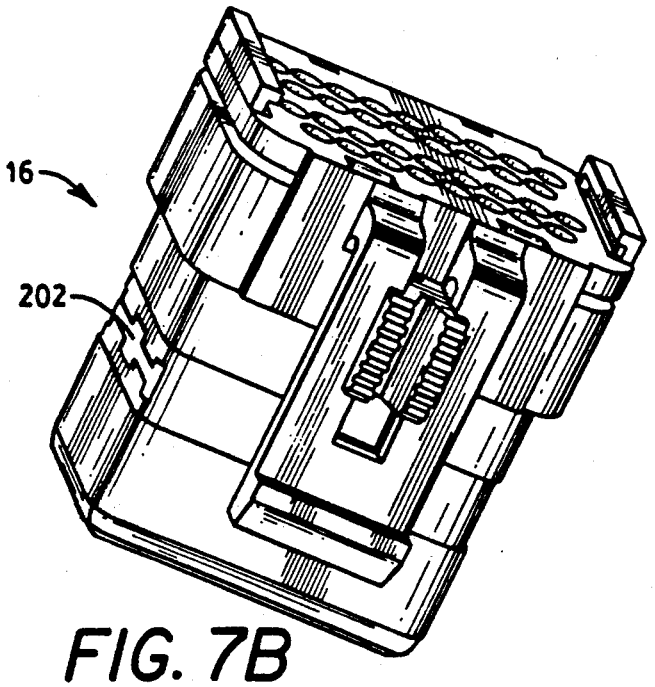
FIG. 7B is a view of the contact locking device of FIG. 7A in a locked position.

In the preferred embodiment, the receptacle housing 16 contains a plurality of first contacts 6 each of which includes an intermediate length having a reduced width or diameter, measured transverse to a longitudinal axis of said first contact, relative to the width or diameter, also measured transverse to said longitudinal axis, of adjacent lengths of said first contact. For example, in the embodiment described herein, each contact 6 may be a female contact 100 having an intermediate length 160 the diameter of which is less than the diameter of adjacent lengths 138, 168. The first connector also includes means 200 insertable through apertures in the receptacle housing 16 and slidable to a first position and a second position, relative to each intermediate length, for unlocking each contact 100 relative to the receptacle housing in the first position, and locking each contact 100 relative to the receptacle housing in the second position. In the particular embodiment depicted in the drawings, the receptacle housing 16 includes a plurality of rows of contacts 100, although the present invention may also be used with a single row of contacts. FIG. 1 depicts four rows of contact 6, which as noted may be in the form of female contacts 100. In this embodiment, the locking/unlocking means 200 includes a first locking member 202 having three legs 204, 206 and 208 which extend into the side wall of the receptacle housing 16 at apertures 210, 212, and 214, respectively, as depicted in FIGS. 1 and 7. Each leg is scalloped at 216 to provide alternating raised lengths 218 and lowered lengths 220 as depicted in FIGS. 1, 8A and 8B. FIGS. 8A and 8B illustrate one scalloped area 216 including a raised length 218 and portions of the adjacent lowered lengths 220. As shown in FIG. 8A, each lowered length 220 will be adjacent to but spaced from the contact 100 when the locking member 202 is in the first position so that a contact 100 can be inserted into or withdrawn from the receptacle housing without interference of the locking member 202. When the locking member 202 is in such first position, it will extend slightly from the receptacle housing 16 as shown in FIG. 7A. When the contacts are loaded in place within the receptacle housing 16, the locking member 202 can be pushed in the direction of arrow 222 further into the receptacle housing 16 to the second position as depicted in FIGS. 7B and 8B in which case each raised length 218 will be adjacent to a first side 224 of an intermediate length 160 of a contact 100 such that each contact 100 will be locked into the receptacle housing 16. As can be seen from FIG. 9, axial movement of each contact 100 will be prevented when the locking member is in the second position depicted in FIG. 8B as a result of the interference provided by an arm 204 of the locking member 202 vis-a-vis shoulders 226, 228 of adjacent lengths 138, 168 of contact 100.

Figure 9:
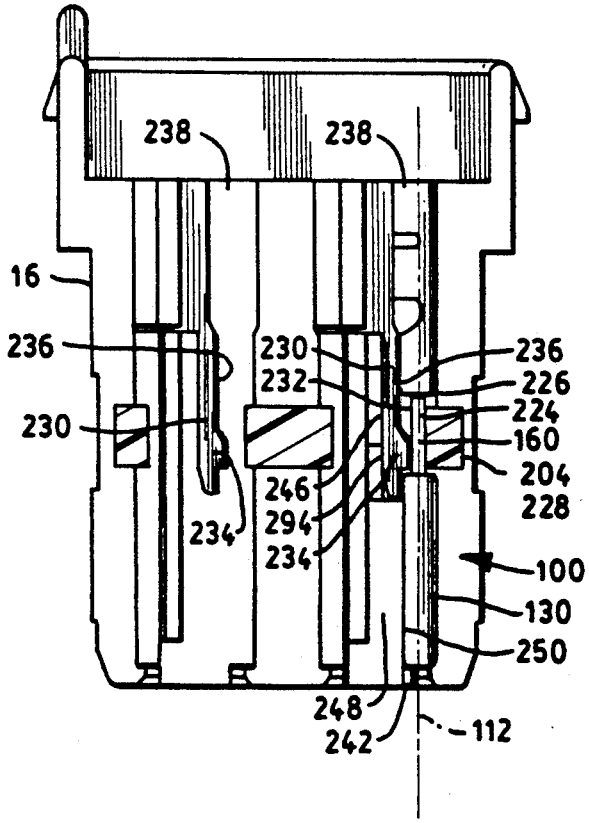
FIG. 9 is a diagrammatic view of the contact locking mechanism of the present invention.

In the preferred embodiment, the receptacle housing 16 includes one or more rows of resilient second locking members 230 as depicted in FIG. 9. Each resilient locking member 230 is integral with the receptacle housing 16 and extends substantially in the same direction as a longitudinal axis 112 of an adjacent contact 100 when a contact 100 is inserted into the receptacle housing. Each resilient locking member 230 includes second means extendable into an opposite second side 232 of an intermediate length 160 of a contact 100 for further locking the contact into the receptacle housing. In the embodiment depicted herein such second means is a protuberance 234 which extends from a first side 236 of the resilient second locking member 230. In assembling the connector device of the present invention, the axial insertion of a contact 100 into the receptacle 16 at opening 238 will cause protuberance 234 of the resilient locking member 230 to snap into place adjacent intermediate length 130 to further prevent axial movement of each contact 100 as a result of the interference provided by the protuberance 234 vis-a-vis shoulders 226 and 228.

In the preferred embodiment, the connector device 2 of the present invention includes a third means 240 which is insertable into the receptacle housing 16 at aperture 242 and slidable to a position adjacent the resilient second locking member 230 for locking the resilient second member 230 against an opposite second side 232 of an intermediate length 160 of a contact 100. Preferably, such third means 240 is a plurality of fingers 244 each of which is slidable to a position adjacent to an opposite second side 246 of a resilient second locking member 230. One or more fingers 244 are preferably integral with a respective base 248 which is configured to mate with a hood 130 of a contact 100. For example, in the preferred embodiment each base 248 is integral with a plurality of fingers 244 as depicted in FIG. 2 and includes one or more channels 250 which are semi-cylindrical in cross-section for mating with a cylindrical hood 130. As will be apparent from FIG. 9, insertion of a base 248 into an aperture 242 will cause a channel 250 to bear against a hood 130 and a finger 244 to bear against side 246 of resilient locking member 230 to facilitate locking a contact 100 within the receptacle housing.

When the connector device of the present invention is fully assembled a wire dress 252 can be attached to the insulator cover means 18 by sliding the tongue members 254 (only one is shown) in the grooves 256 as depicted in FIG. 2. In addition, the receptacle housing 16 can be inserted through a perimeter seal 258 which will serve to cover the apertures 210, 212, 214 to hold the locking member 202 in place.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

We claim:

1. In a connector device which includes a first connector having a plurality of first contacts for mating with a second connector having a plurality of corresponding second contacts, said first contacts being electrically connected to said second contacts when said first connector is coupled to said second connector, wherein the improvement comprises a first connector which comprises:

(a) a receptacle housing for containing one or more rows of said first contacts, each of said first contacts having a long axis and an intermediate length and adjacent lengths in either end thereof, said intermediate length having a given width which is less than the widths of said adjacent lengths, and (b) first locking means insertable through at least one aperture in said receptacle housing and slidable to first and second positions relative to said intermediate lengths, said contacts being unlocked in said first position and locked in said second position of said first locking means, relative to said receptacle housing, said first locking means including a first locking member having one or more legs which extend freely into one or more apertures of said receptacle housing, each leg being scalloped to provide continuous alternating raised and lowered lengths of said leg, each lowered length being adjacent to but spaced from a respective first contact when said first locking means is in said first position whereby each first contact can be inserted into or withdrawn from said receptacle housing without interference of said locking member, and each raised length being adjacent o a first side of said intermediate length of a respective first contact when said first locking means is in said second position whereby each first contact is locked into said receptacle housing.

2. The connector device of claim 1 wherein said receptacle housing includes one or more rows of resilient second locking members, each resilient second locking member being integral with said receptacle housing and extending substantially in the same direction as a longitudinal axis of an adjacent first contact when said first contacts are inserted into said receptacle housing, each resilient second locking member including second means extendable into an opposite second side of an intermediate length of a respective first contact for further locking a first contact into said receptacle housing when said first contacts are inserted into said receptacle housing.

3. The connector device of claim 2 wherein said second means is a protuberance which extends from a first side of said resilient second locking member.

4. The connector device of claim 2 further including a third means insertable into said receptacle housing and slidable to a position adjacent said resilient second locking members for locking each second means against an opposite second side of an intermediate length of a first contact for further locking a first contact into said receptacle housing when said first contacts are inserted into said receptacle housing.

5. The connector device of claim 4 wherein said second means is a protuberance which extends from a first side of said resilient second locking member, and further wherein said third means includes a plurality of fingers each of which is slidable to a position adjacent to an opposite second side of a resilient second locking member.

6. The connector device of claim 5 wherein each first contact will be a female contact which comprises means disposed at a first end for attaching an electrical conductor to said female contact, and an opposite second end, said opposite second end comprising an aperture for receiving a corresponding male contact and a hood which is concentric relative to said opposite second end and includes an inner surface which engages an outer surface of said opposite second end, said intermediate length being disposed between said first end and said second end.

7. The connector device of claim 6 wherein said third means further includes one or more base portions, each base portion being integral with one or more fingers of said plurality of fingers, each base portion being configured to mate with a hood.

8. The connector device of claim 7 wherein each hood is cylindrical and each base portion includes at least one channel which is semi-cylindrical in cross section for mating with a hood.

9. The connector device of claim 8 wherein each opposite second end comprises three identical resilient beams which are equally spaced about a longitudinal axis of said female contact and include opposing female contact surfaces configured to engage a male contact of said plurality of corresponding male contacts, when said first connector is coupled to said second connector, at corresponding male contact surfaces which are equally spaced about a longitudinal axis of said male contact.

10. The connector device of claim 5 further including said second connector, said first connector comprising fourth means for removably coupling said first connector to said second connector, said fourth means including a latch integral with said first connector, and fifth means integral with said second connector for mating with said fourth means, said fifth means including a bracket integral with said second connector and alignable with and receivable of said latch when said first connector is coupled to said second connector; said fourth means further including a sixth means disposed between said latch and said first connector and slidable relative to said latch to a first position and a second position for unlocking said latch relative to said bracket when said sixth means is in said first position, and locking said latch relative to said bracket when said sixth means is in said second position, when said first connector is coupled to said second connector.

11. The connector device of claim 10 wherein each first contact will be a female contact and comprises means disposed at a first end for attaching an electrical conductor to said female contact, and an opposite second end, said opposite second end comprising an aperture for receiving a corresponding male contact and a hood which is concentric relative to said opposite second end and includes an outer surface which engages an outer surface of said opposite second end, said intermediate length being disposed between said first end and said second end.

12. The connector device of claim 11 wherein said third means further includes one or more base portions, each base portion being integral with one or more fingers of said plurality of fingers, each base portion being configured to mate with a hood.

13. The connector device of claim 12 wherein each hood is cylindrical and each base portion includes at least one channel which is semi-cylindrical in cross section for mating with a hood.

14. The connector device of claim 13 wherein each opposite second end comprises three identical resilient beams which are equally spaced about a longitudinal axis of said female contact and include opposing female contact surfaces configured to engage a male contact of said plurality of corresponding male contacts, when said first connector is coupled to said second connector, at corresponding male contact surfaces which are equally spaced about a longitudinal axis of said male contact.

* * * * *